US006549182B2

(12) United States Patent
Nitta et al.

(10) Patent No.: US 6,549,182 B2
(45) Date of Patent: Apr. 15, 2003

(54) LIQUID CRYSTAL DRIVING CIRCUIT AND LIQUID CRYSTAL DISPLAY DEVICE

(75) Inventors: Hiroyuki Nitta, Ebina (JP); Atsuhiro Higa, Yokohama (JP); Tsutomu Furuhashi, Yokohama (JP); Satoru Tsunekawa, Higashimurayama (JP); Hiroshi Kurihara, Mobara (JP)

(73) Assignees: Hitachi, Ltd., Tokyo (JP); Hitachi Video and Information Systems, Inc., Yokohama (JP)

( * ) Notice: Subject to any disclaimer, the term of this patent is extended or adjusted under 35 U.S.C. 154(b) by 0 days.

(21) Appl. No.: 09/928,424

(22) Filed: Aug. 14, 2001

(65) Prior Publication Data

US 2002/0027551 A1 Mar. 7, 2002

Related U.S. Application Data

(63) Continuation of application No. 09/206,986, filed on Dec. 8, 1998, now Pat. No. 6,275,207.

(30) Foreign Application Priority Data

Dec. 8, 1997 (JP) ..... 9-336769

(51) Int. Cl.[7] ..... G09G 3/36
(52) U.S. Cl. ..... 345/89; 345/98; 345/147
(58) Field of Search ..... 345/89, 88, 155, 345/208, 210, 211, 100, 147, 153; 349/34, 37, 174

(56) References Cited

U.S. PATENT DOCUMENTS 4,581,654 A 4/1986 Kobayashi et al. ..... 345/230
4,921,334 A * 5/1990 Akodes ..... 350/333
5,175,535 A 12/1992 Yamazaki et al. ..... 345/100
5,202,676 A 4/1993 Yamazaki ..... 345/100
5,495,287 A * 2/1996 Kasai et al. ..... 345/89
5,774,106 A 6/1998 Nitta et al. ..... 345/98
5,886,755 A * 3/1999 Imoto et al. ..... 349/37

OTHER PUBLICATIONS

B. Conner et al., "Low–Power 6–bit Column Driver for AMLCDs", *1994 SID International Symposium Digest of Technical Papers* (*SID 94 Digest*), vol. XXV, pp. 351–354, Jun. 14–16, 1994, San Jose, CA, USA, published by Society for Information Display.

* cited by examiner

*Primary Examiner*—Amare Mengistu
(74) *Attorney, Agent, or Firm*—Antonelli, Terry, Stout & Kraus, LLP

(57) ABSTRACT

A display device for displaying display data including a display panel; a driving circuit which generates a gray-scale voltage corresponding to the display data and outputs the gray-scale voltage to the display panel; a scan driver which scans a line on the display panel to which the gray-scale voltage is output; and a control circuit which outputs the display data to the driving circuit and outputs a display control signal to the scan driver. A gray-scale display characteristic of the display data is changeable between a first state in which a difference in a brightness of the display panel between two adjacent display data values becomes smaller as a display data gray-scale increases, and a second state in which the difference in the brightness of the display panel between two adjacent display data values becomes larger as the display data gray-scale increases.

23 Claims, 8 Drawing Sheets

(a) SETTING OF LIGHT GRAY-SCALE AS A WHOLE (b) SETTING OF DARK GRAY-SCALE AS A WHOLE (a) SETTING OF LIGHT GRAY-SCALE AS A WHOLE (b) SETTING OF DARK GRAY-SCALE AS A WHOLE (c) SETTING OF INTERMEDIATE GRAY-SCALE

LIQUID CRYSTAL DRIVING CIRCUIT AND LIQUID CRYSTAL DISPLAY DEVICE

CROSS-REFERENCE TO RELATED APPLICATION

This application is a continuation of application Ser. No. 09/206,986 tiled on Dec. 8, 1998, now U.S. Pat. No. 6,275,207, the contents of which are hereby incorporated herein by reference in their entirety.

BACKGROUND OF THE INVENTION

1. Field of the Invention

The present invention relates to a liquid crystal display device in which the display gray-scale of a liquid crystal panel can be adjusted, and a liquid crystal driving circuit therefor.

2. Description of the Related Art

A conventional liquid crystal driving circuit inputs display data, generates gray-scale voltages, selects the gray-scale voltage corresponding to the given display data and then outputs the gray-scale voltage thus selected to a liquid crystal panel.

For example, in a liquid crystal driving circuit for outputting 64-gray-scale voltages, 8-gray-scale voltages are generated by resistance-dividing each section between two respectively adjacent reference voltages of 9 levels supplied from an external device, and finally 64-gray-scale voltages in total are generated. The gray-scale voltage corresponding to each display data is selected from the 64-gray-scale voltages thus generated, and output to the liquid crystal panel.

For example, 1994 SID INTERNATIONAL SYMPOSIUM DIGEST of TECHNICAL PAPERS 23:2 (pp. 351–354) discloses a liquid crystal driving circuit for generating and outputting gray-scale voltages on the basis of reference voltages supplied externally.

In this liquid crystal driving circuit, a reference voltage is adjusted to generate and output a gray-scale voltage to a liquid crystal panel having a non-linear brightness vs. applied voltage characteristic as generally shown in FIG. 4 so that the output voltage to the display data is matched with the characteristic of the liquid crystal panel.

However, in the conventional technique, the resistance values of voltage-dividing resistors are fixed, and eight gray-scale voltages generated on the basis of two reference voltage values have a linear relationship. When the gray-scale voltage is near to 1V or 4V, the eight brightness values thus obtained have a non-linear relationship to the gray-scale code as shown in FIG. 4 of the prior art as in the case of transmittance.

Accordingly, it is insufficient to merely adjust the reference voltage in order to adjust the display brightness balance (gray-scale display characteristic) of each gray-scale. Therefore, it has hitherto been difficult to perform γ-correction to correct distortion of the gray-scale display characteristic due to an inherent characteristic of a device, and implement a gray-scale display characteristic and a color tone which are matched with a user's taste or suitable for displaying a target image.

An object of the present invention is to provide a liquid crystal driving circuit and a liquid crystal display device which can adjust the display brightness and the variation characteristic of color to display data values input.

SUMMARY OF THE INVENTION

Embodiments of the present invention disclosed in this application will be described briefly as follows.

That is, according to a first aspect of the present invention, there is provided a liquid crystal driving circuit for driving a data line of a liquid crystal panel including the data line and a scan line to apply a voltage to liquid crystal, which is characterized by comprising: a latch address control circuit for successively generating a latch signal to pick up display data; a first holding circuit for picking up and holding the display data of an amount corresponding to an output data line in accordance with the latch signal; a second holding circuit for further picking up and holding the display data, held in the first holding circuit, of the amount corresponding to the output data line in accordance with a horizontal synchronous signal at the same time; a set register for operating setting of a gray-scale voltage value of gray-scale voltage; a gray-scale voltage generating circuit for receiving a plurality of different reference voltages and generating gray-scale voltages whose number is larger than that of the reference voltages in response to an instruction of the set register; a gray-scale voltage selection circuit for selecting the gray-scale voltage in accordance with the display data held in the second holding circuit; and an amplifying circuit for amplifying and outputting the gray-scale voltage selected by the selection circuit.

It is preferable that the gray-scale voltage generating circuit has a plurality of variable resistors whose resistance values can be set by the set register, and difference voltages among a plurality of liquid-crystal power sources are resistance-divided by the variable resistors to generate the gray-scale voltages.

It is preferable that each of the variable resistors includes plural resistors and switches for excluding the corresponding resistance component of the plural resistors in the variable resistor.

It is preferable that the amplifying circuit has an operational amplifier, wherein the operational amplifier includes one or plural variable resistors whose resistance values can be set by the set register, thereby determining an amplification factor.

Further, according to a second aspect of the present invention, there is provided a liquid crystal driving circuit for driving a data line of a liquid crystal panel including the data line and a scan line to apply a voltage to liquid crystal, which is characterized by comprising: a latch address control circuit for successively generating a latch signal to pick up display data; a first holding circuit for picking up and holding the display data of an amount corresponding to an output data line in accordance with the latch signal; a second holding circuit for further picking up and holding the display data, held in the first holding circuit, of the amount corresponding to the output data line in accordance with a horizontal synchronous signal at the same time; a set register for operating setting of a gray-scale voltage value of gray-scale voltage; a gray-scale voltage generating circuit for receiving a plurality of different reference voltages and generating gray-scale voltages whose number is larger than that of the reference voltages in response to an instruction of the set register; a gray-scale voltage selection circuit for selecting the gray-scale voltage in accordance with the display data held in the second holding circuit; and an amplifying circuit for shifting the gray-scale voltage selected in the selection circuit by an offset voltage, amplifying the gray-scale voltage thus shifted with an amplification factor indicated by the set register, and then outputting the gray-scale voltage thus amplified.

It is preferable that the set register for setting the amplification factor of each operational amplifier of the amplifying circuit is provided for each of three colors R(red), G(green) and B(blue), and each set register can set and change the amplification factor for every color.

It is preferable that the offset voltage of the amplifying circuit is generated by resistance-dividing an offset reference voltage and a common voltage with a plurality of variable resistors so that the voltage value of the offset voltage is variable.

It is preferable that the set register is supplied with set register setting data to set the set data with a set data set clock, or is supplied with set value data to generate set data on the basis of a clock signal generated by multiplying a latch signal from a latch address control circuit and a set enable signal.

Still further, according to a third aspect of the present invention, there is provided a liquid crystal display device which is characterized by comprising: the above liquid crystal driving circuit; a liquid crystal panel which includes a data line and a scan line to apply a voltage to liquid crystal; a scan driver for driving the scan line of the liquid crystal panel; a control circuit for setting the gray-scale voltage output from the liquid crystal driving circuit to control the liquid crystal driving circuit and the scan driver; and a reference voltage generating circuit for generating reference voltages for the liquid crystal driving circuit, wherein input display data are converted to a variable gray-scale voltage and displayed on the liquid crystal panel.

Still further, according to a fourth aspect of the present invention, a liquid crystal driving circuit for driving a data line of a liquid crystal panel having the data line and a scan line, is characterized by comprising: a holding circuit for holding display data of an amount corresponding to an output data line; a set register for setting the voltage value of a gray-scale voltage; a gray-scale voltage generating circuit for receiving plural different reference voltages and generating on the basis of an instruction of the set register gray-scale voltages whose number is larger than that of the reference voltages; and a gray-scale voltage selection circuit for selecting a gray-scale voltage in accordance with the display data held in the holding circuit.

DETAILED DESCRIPTION OF THE PREFERRED EMBODIMENTS

Preferred embodiments according to the present invention will be described with reference to the accompanying drawings.

First Embodiment

A liquid crystal driving circuit according to a first embodiment of the present invention will be described with reference to FIGS. 1 to 8.

Figure 1:
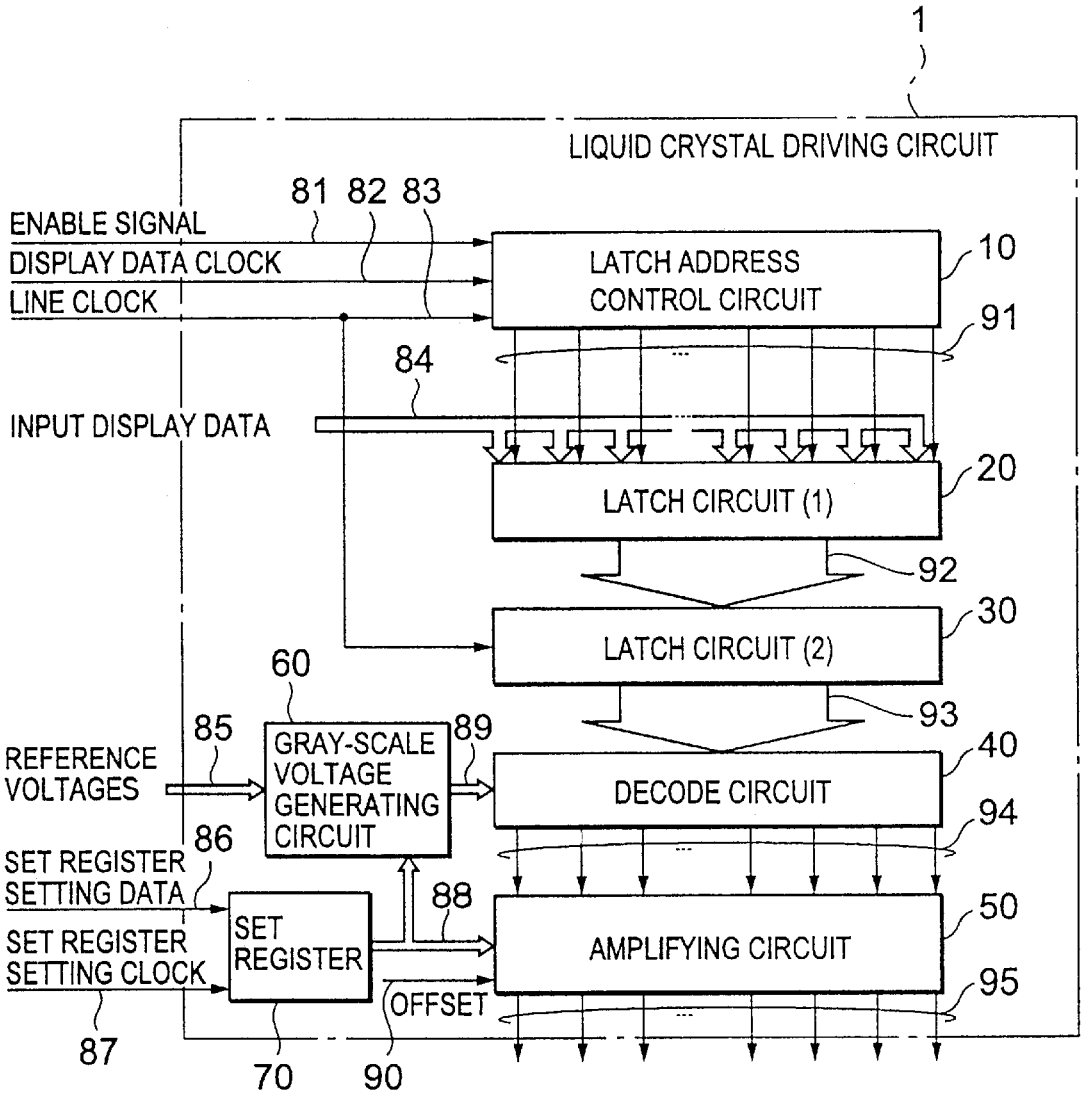
FIG. 1 is a block diagram showing the construction of a first embodiment of a liquid crystal driving circuit according to the present invention.

FIG. 1 is a block diagram showing a liquid crystal driver according to the first embodiment of the present invention.

In FIG. 1, a liquid crystal driving circuit 1 includes a latch address control circuit 10, a latch circuit (1) 20, a latch circuit (2) 30, a decode circuit 40, an amplifying circuit 50, a gray-scale voltage generating circuit 60 and a set register 70.

The latch address control circuit 10 is supplied with an enable signal 81, a display data clock 82 and a line clock 83, and outputs latch signals 91. The latch circuit (1) 20 is supplied with the latch signals 91 and input display data 84, and outputs latch circuit (1) data 92.

The latch circuit (2) 30 is supplied with a line clock 83 and the latch circuit (1) data 92, and outputs latch circuit (2) data 93.

The set register 70 is supplied with set register setting data 86 and set register setting clock 87, and outputs set data 88.

The gray-scale voltage generating circuit 60 is supplied with reference voltages 85 and the set data 88, and outputs a gray-scale voltages 89. The decode circuit 40 is supplied with the latch circuit (2) data 93 and the gray-scale voltage 89, and outputs selection voltages 94. The amplifying circuit 50 is supplied with offset voltages 90, the selection voltages 94 and the set data 88, and outputs liquid crystal applying voltages 95.

Next, the operation of the liquid crystal driving circuit 1 according to the present invention will be described with reference to the block diagram of FIG. 1.

First, a data pickup operation will be described.

The latch address control circuit 10 generates the latch signals 91 from the display data clock 82 when the enable signal 81 input becomes active, and outputs the latch signals 91 to the latch circuit (1) 20.

The latch signals 91 are used to pick up the input display data into the latch circuit (1) 20.

The latch circuit (1) 20 picks up the input display data 84 into the internal latches corresponding to each output of the liquid crystal applying voltages 95 in accordance with the latch signal 91.

The latch address control circuit 10 outputs the enable signal 81 when the pickup of the input display data 84 of one line by the latch circuit (1) 20 is completed, and returns to its initial state in accordance with the line clock 83. Through this operation, it is possible to perform the data pickup operation of picking up the input display data 84 into the latch circuit (1).

Next, the data output operation will be described.

The latch circuit (2) 30 picks up the latch circuit (1) data 92 at the timing of the line clock 83 which is active after all the input display data 84 of one line period are picked up into the latch circuit (1) 20.

The output of the latch circuit (2) 30 are output to the decode circuit 40.

The set register 70 outputs the set data 88 to the amplifying circuit 50 and the gray-scale voltage generating circuit 60, the set data 88 being obtained by setting the set register setting data 86 with the set register setting clock 87.

The gray-scale voltage generating circuit 60 generates the gray-scale voltage 89 on the basis of the reference voltage 85 in accordance with the set data 88, and outputs the gray-scale voltage 89 to the decode circuit 40.

The decode circuit 40 selects the gray-scale voltage 89 in accordance with the data of each pixel of the latch circuit (2) data 93, and outputs the selection voltage 94 of each pixel.

The amplifying circuit 50 buffers the selection voltage 94 and outputs the liquid crystal applying voltage 95.

The data output operation is made possible through the above operation.

Next, the construction of the gray-scale voltage generating circuit 60 will be described in detail with reference to FIGS. 2 and 3 on the basis of a case where 64 gray-scales are generated.

Figure 2:
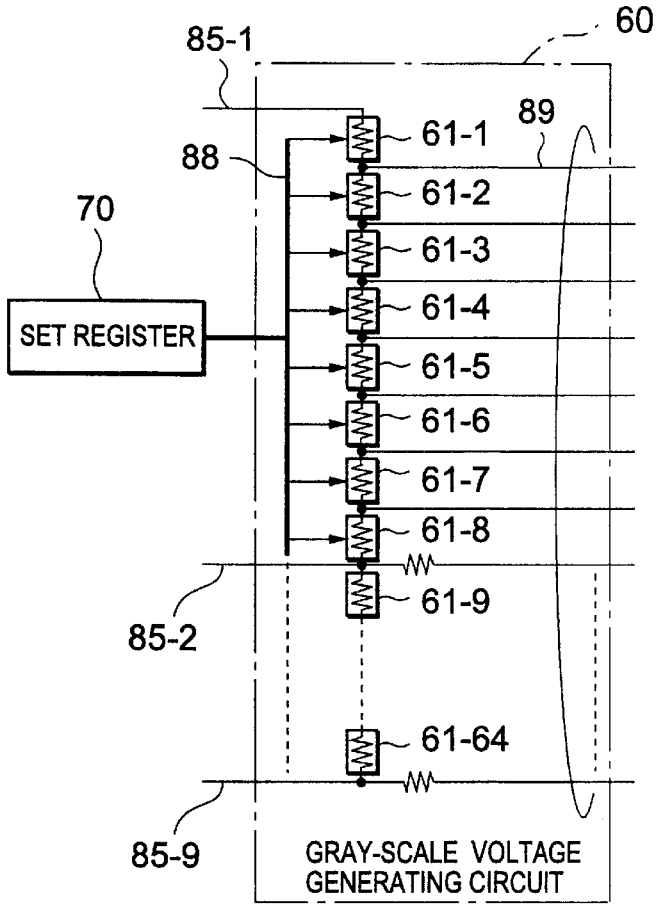
FIG. 2 is a block diagram showing the internal construction of a gray-scale voltage generating circuit of the liquid crystal driving circuit shown in FIG. 1.
Figure 3:
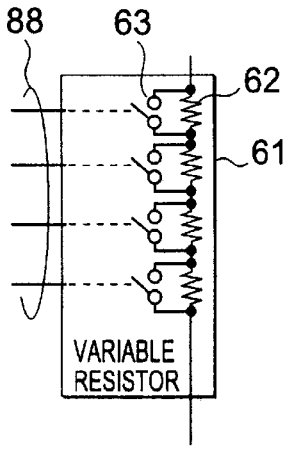
FIG. 3 is a diagram showing the construction of a variable resistor of the gray-scale voltage generating circuit of the liquid crystal driving circuit shown in FIG. 2.

FIG. 2 is a block diagram showing the construction of the gray-scale voltage generating circuit 60, and FIG. 3 is a diagram showing the construction of a variable resistor 61 of the gray-scale voltage generating circuit 60.

The gray-scale voltage generating circuit 60 is constructed by connecting variable resistors 61-1 to 61-64 in series, and the reference voltages 85 are input to the gray-scale voltage generating circuit 60 every eight variable resistors. The first reference voltage 85-1 is applied to one end of the variable resistor 61-1, the second reference voltage 85-2 is applied to the connection point between the variable resistors 61-8 and 61-9, and the ninth reference voltage is applied to the other end of the variable resistor 61-64.

The resistance value of each variable resistor 61 is set in accordance with the set data 88.

The variable resistor 61 is constructed by plural fixed resistors 62 which are connected in series, and each fixed resistor 62 is connected in parallel to a short-circuiting switch 63.

The short-circuiting switch 63 is switched (opened/closed) in accordance with the set data 88 to thereby vary the resistance value of the variable resistor 61.

The gray-scale voltage generating circuit 60 divides a voltage reference between the first reference voltage 85-1 and the second reference voltage 85-2 by the variable resistors 61-1 to 61-8, whereby gray-scale voltages 89 for eight gray-scale levels are generated on the basis of the reference voltages of two levels. As a result, a total of 64-level gray-scale voltages 89 are generated from 9-level reference voltages 85.

Each variable resistor 61 is constructed by connecting a pair of a resistor 62 and a short-circuiting switch 63 in parallel (hereinafter referred to as "switch parallel connection") and then connecting in series a plurality of such pairs each comprising a switch parallel connection of a resistor 62 and a short-circuiting switch 63. Each short-circuiting switch 63 is connected to the set register 70, and switched on/off in accordance with the set data 88. When the switch 63 is off, current flows through the resistor 62 which is connected to the switch 63 in parallel, and thus a voltage drop occurs.

On the other hand, when the switch 63 is on, current flows through the switch 63 and no voltage drop occurs.

By controlling the switch on/off operation of these switches 63, the resistance value of the variable resistor 61 can be controlled by the set register 70. Accordingly, each of the eight gray-scale voltages 89 generated on the basis of the two reference voltages can further be easily varied by changing the resistance value of each variable resistor, that is, changing the voltage dividing ratio. This is applicable to the voltage values generated on the basis of the other reference voltages 85.

Figure 4:
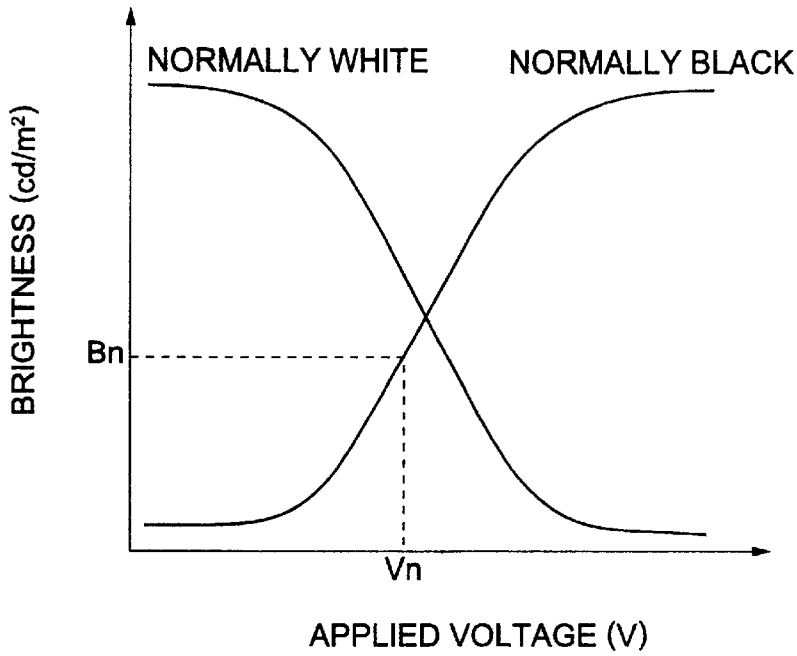
FIG. 4 is a diagram showing the relationship between the applied voltage of a liquid crystal panel and the brightness thereof.

Here, as shown in FIG. 4, the relationship between the applied voltage of the liquid crystal panel and the display brightness is different between a normally black mode liquid crystal panel and a normally white mode liquid crystal panel. The normally black mode liquid crystal panel has low brightness under a low applied voltage and high brightness under a high applied voltage. Further, this characteristic is represented by an S-shaped curve which is saturated both in a low applied voltage area and in a high applied voltage area. The relationship between the applied voltage and the display brightness of the normally white mode liquid crystal panel has the characteristic which is opposite (symmetric) to that of the normally black mode liquid crystal panel. The present invention can be applied irrespective of the mode of the liquid crystal panel. In the following description it is assumed that the liquid crystal panel is the normally black mode liquid crystal.

Next, FIG. 3 shows a case where the resistance value of each resistor 62 of the variable resistor 61 is set to 50 Ω. As a reference status there is defined such a status that two of the four switches 63 are switched on while the other two switches are switched off so that the potential difference between the two reference voltages is set to 1V and each voltage-dividing resistance value is set to 100 Ω.

Figure 5:
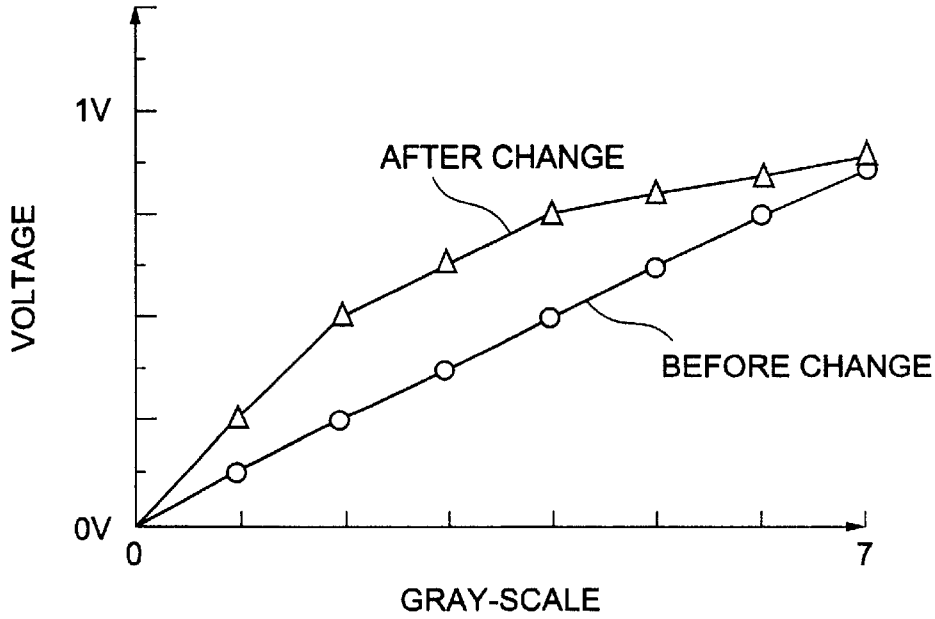
FIG. 5 is a diagram showing the gray-scale voltage generated by the gray-scale voltage generating circuit of the liquid crystal driving circuit shown in FIG. 1.

Here, when the difference in brightness is small between low gray-scales and it is large between high gray-scales, the resistance value between the low gray-scales is increased, and the resistance value between the high gray-scales is reduced. For example, when the setting of the resistance values is made again so that the resistance value of the variable resistors 61-8 and 61-7 of FIG. 2 is equal to 200 Ω, the resistance value of the variable resistors 61-6 and 61-5 is equal to 100 Ω and the resistance value of the resistors 61-4 to 61-1 is equal to 50 Ω, each of the gray-scale voltages 89 of eight gray-scales is varied as shown in FIG. 5. That is, at the low gray-scale, the inter-gray-scale potential difference between the gray-scales is increased, and at the high gray-scale the potential difference is reduced. In other words, the brightness difference is increased at the low gray-scale, and it is reduced at the high gray-scale.

The gray-scale display characteristic can be changed by freely varying the resistance-dividing ratio as described above.

Next, the relationship between the input display data 84 and the actual display brightness, which can be obtained in accordance with the setting mode of the resistance-dividing ratio, will be described with reference to FIGS. 6A to 6C.

Figure 6A:
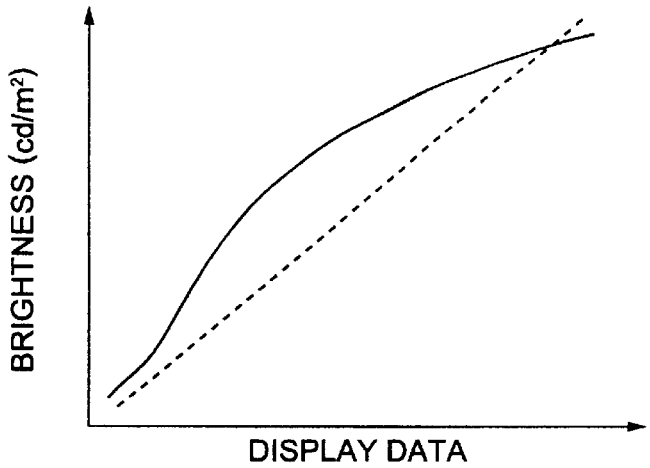
FIGS. 6A to 6C are diagrams showing variation of the relationship between input display data and brightness when the set data of the liquid crystal driving circuit shown in FIG. 1 is changed.

FIG. 6A is a graph showing a setting mode in which the gray-scale display is lighter as a whole, and this mode is suitable for display of natural pictures. In this mode, the setting is made so that each resistance-dividing ratio is higher for low display data while it is lower for high display data.

Figure 6B:
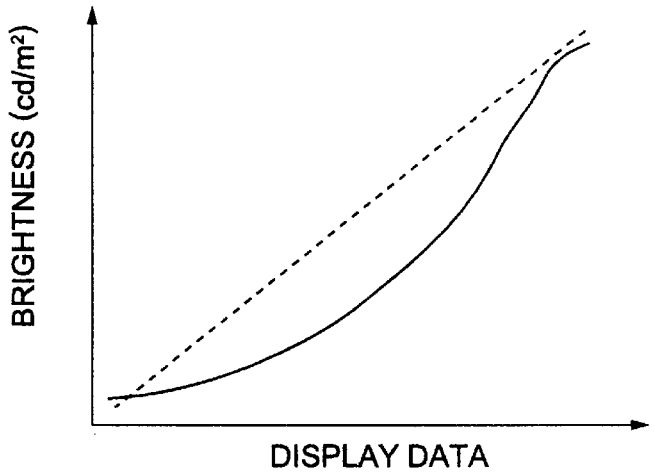

FIG. 6B is a graph showing a setting mode in which the gray-scale display is darker as a whole, and this mode is suitable for display of computer graphics and text. The setting is made so that each resistance-dividing ratio is lower for low display data while it is higher for high display data.

Figure 6C:
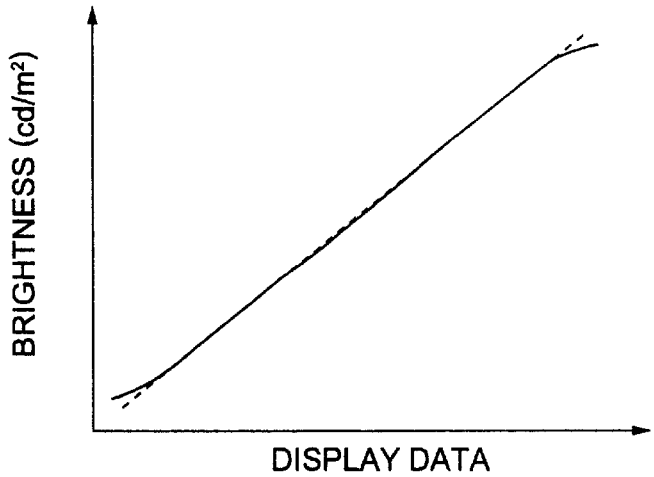

FIG. 6C is a graph showing a setting mode in which the relationship between the input display data 84 and the actual display brightness is linear. The setting is made so that each resistance-dividing ratio is higher in the vicinity of a S-shaped curve shown in FIG. 4.

In the foregoing description, the variable resistor 61 is constructed by connecting in series a plurality of resistors 62 each of which is connected in parallel to a switch. However, the same effect could be obtained if the variable resistor 61 is constructed by connecting in parallel a plurality of resistors 62 each of which is connected to a switch in series. That is, the resistance-dividing ratio can be changed by switching the switches connected in series to the resistors on or off.

Further, the variable resistor 61 may be constructed by combining a plurality of resistors 62 each connected to the above switch in parallel and a plurality of resistors 62 each connected to the above switch in series. For example, the same effect could be obtained if a pair of resistors 62 each connected to the switch in parallel are connected to each other in series and plural pairs of resistors 62 each connected to the switch in series are connected to one another in parallel. That is, the resistance-dividing ratio can be changed by switching the switches connected in parallel to the resistors 62 on or off.

Next, a method of setting the resistance value of the variable resistor will be described.

Figure 7:
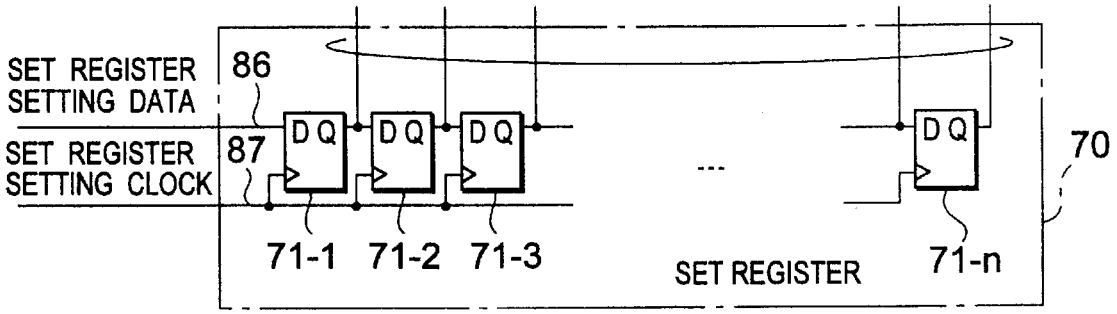
FIG. 7 is a diagram showing the construction of a set register of the liquid crystal driving circuit shown in FIG. 1.

FIG. 7 shows the internal construction of the set register 70. In FIG. 7, reference numerals 71-1 to **71-*n*** represent latches.

As shown in FIG. 7, the set register 70 is supplied with the set register setting data 86 and the set register setting clock 87.

In the case of the variable resistor 61 shown in FIG. 3, the 4-bit setting data 88 are needed, and thus the bit number of the register is set to (the number of variable resistors 61)×4 bits.

The set register 71 functions as a shift register, and the set register setting data 86 are successively shifted from the latch 71-1 for holding each setting data by the set register setting clock 87.

When all the set register setting data 86 and the set register setting clock 87 are input, the setting is completed. During the setting period, the gray-scale voltage is unstable. Therefore, it is preferable that the setting is finished after the power source is switched on and before the display is started, and the display is started after the gray-scale voltage has sufficiently stabilized.

As described above, the resistance value of each variable resistor can be set by using the set register setting data 86 and the set register setting clock 87.

According to the liquid crystal driving circuit of the present invention, an offset adjustment and an amplification factor adjustment for the selection voltage 95 which selected the gray-scale voltage 94 at the decode circuit 40 are further performed, and also a fine adjustment of the liquid crystal applying voltage 95 to the input display data 84 is further performed.

The output voltage offset adjustment and the amplification factor adjustment will be described with reference to FIG. 8.

Figure 8:
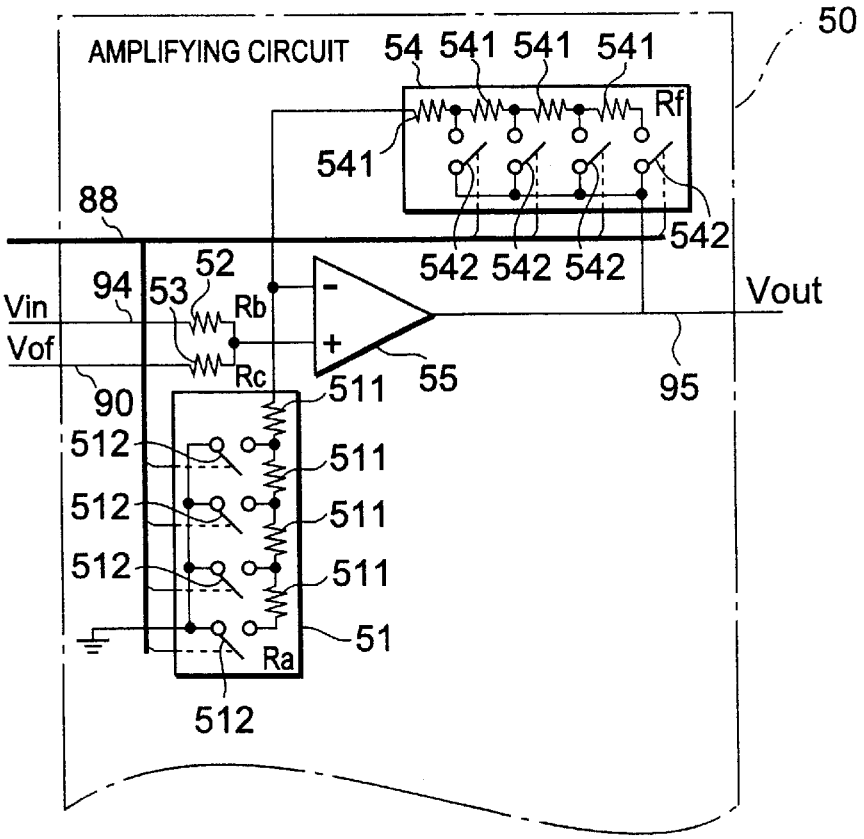
FIG. 8 is a diagram showing the construction of one output of an amplifying circuit of the liquid crystal driving circuit shown in FIG. 1.

FIG. 8 is a internal block diagram showing one output of the amplifying circuit 50.

The amplifying circuit 50 has a resistor Ra 51, a resistor Rb 52, a resistor Rc 53, a resistor Rf 54 and an operational amplifier 55. The resistor Ra 51 has a plurality of resistors 511 which are connected to one another in series, and a plurality of switches 512. The resistor Rf 54 has a plurality of resistors 541 which are connected to one another in series, and a plurality of switches 542.

The positive input terminal (+) of the operational amplifier 55 is supplied with the output 94 of the decode circuit 40 through the resistor Rb 52 and with an offset signal 90 through the resistor Rc 53. The negative input terminal (−) of the operational amplifier 55 is supplied with a voltage obtained by dividing the output of the operational amplifier 55 with the resistors Rf 54 and Ra 51.

The switches 512 and 542 of the resistors Ra 51 and Rf 54 are selectively closed in accordance with the setting data 88, whereby a desired resistance value can be set.

Figure 9:
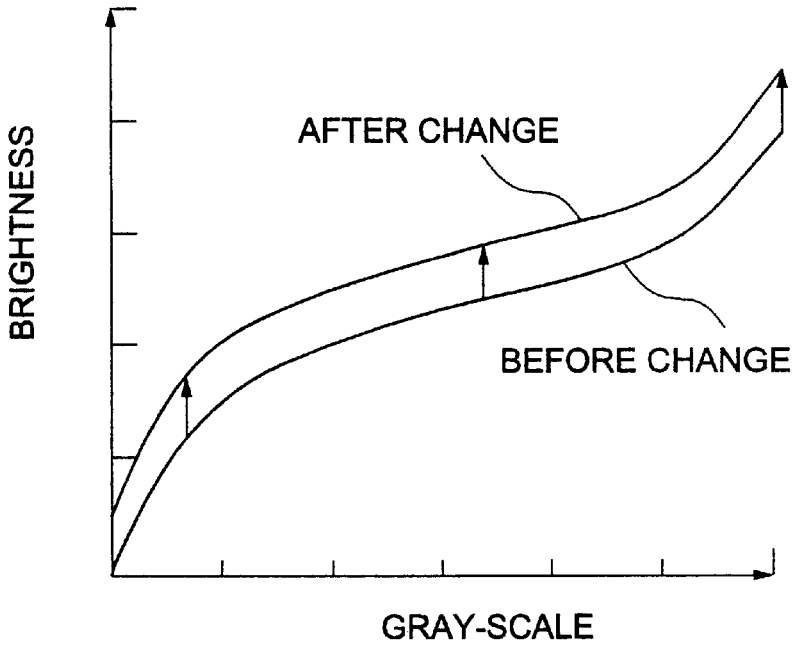
FIG. 9 is a diagram showing a gray-scale vs. voltage characteristic of offset adjustment of the liquid crystal driving circuit shown in FIG. 1.
Figure 10:
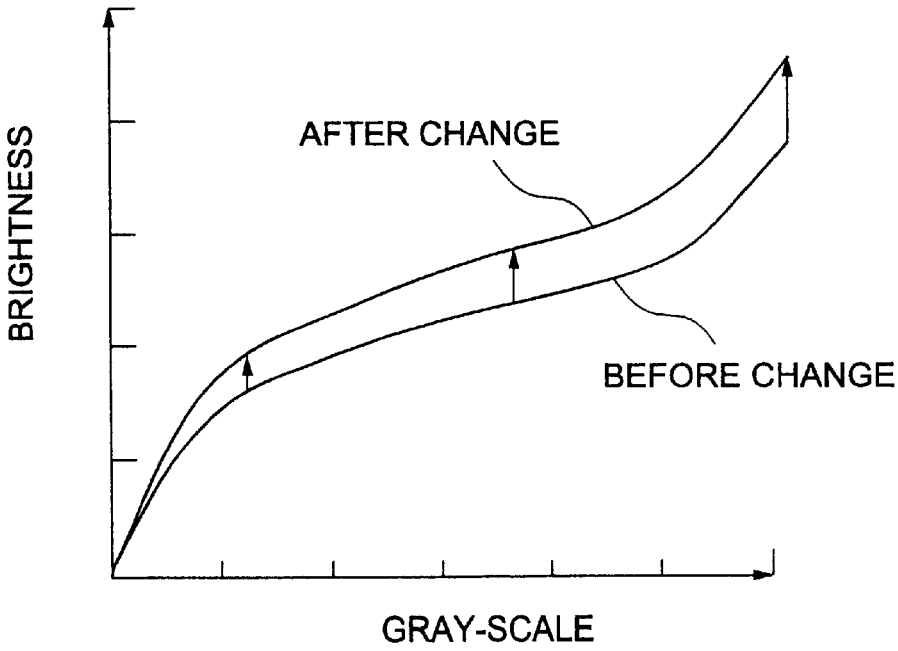
FIG. 10 is a diagram showing a gray-scale vs. voltage characteristic of amplification factor adjustment of the liquid crystal driving circuit shown in FIG. 1.

FIG. 9 shows a gray-scale vs. voltage characteristic when the offset adjustment is carried out, and FIG. 10 shows a gray-scale vs. voltage characteristic when the amplification factor adjustment is carried out.

First, the offset adjustment will be described.

In the offset adjustment, the display brightness is increased or reduced by increasing or reducing each gray-scale voltage by an amount corresponding to a fixed voltage as shown in FIG. 9. As described above, the brightness of a display image can be adjusted by adjusting the offset amount of the gray-scale vs. voltage characteristic.

Next, the amplification factor adjustment will be described.

In the amplification factor adjustment, the display brightness is increased or reduced by increasing or reducing the gray-scale voltage by an amount corresponding to a fixed rate as shown in FIG. 10. As described above, the contrast of a display image can be adjusted by adjusting the amplification factor of the gray-scale vs. voltage characteristic.

FIG. 8 is a circuit diagram for implementing the offset adjustment of FIG. 9 and the amplification factor adjusting shown in FIG. 10. In this case, the output voltage Vout of the amplifying circuit 50 is expressed by the following equation (1):

$$Vout = \left(1 + \frac{Rf}{Ra}\right)\frac{Rc}{Rb + Rc}(Vin - Vof) \tag{1}$$

In order to implement the offset adjustment, the positive input terminal (+) of the operational amplifier 55 of the amplifying circuit 50 is supplied with a voltage which is obtained by voltage-dividing the selection voltage 94 (represented by Vin) and the offset voltage 90 (represented by Vof) with the resistors Rb 52 and Rc 53.

At this time, the voltage at the positive input terminal is equal to (Vin−Vof)×Rc/(Rb+Rc). For example, assuming that the ratio of the resistance values of the variable resistors Ra 51 and Rf 54 is equal to 1, the gain of the operational amplifier 55 is equal to 2, and the output voltage Vout of the amplifying circuit 50, that is, the liquid crystal applying voltage 95 is equal to double the voltage at the positive input terminal of the operational amplifier 55.

Here, assuming that Ra 51=Rf 54 and the voltage at the positive input terminal is equal to (Vx−Vof)/2, Vout=(Vx−Vof) can be obtained by multiplying the voltage at the positive input terminal by 2. That is, the output voltage Vout is uniformly shifted by the offset voltage (Vof) 90.

The offset amount of the output voltage Vout of the amplifying circuit 50 can be adjusted as described above.

As shown in FIG. 8, the variable resistor Ra 51 and the variable resistor Rf 54 which determine the amplification factor of the operational amplifier 55 respectively vary the resistance values thereof by combining plural resistors 511 and plural switches 512 (plural resistors 541 and plural switches 542) and controlling the switching operation of the corresponding switches.

The amplification factor of the operational amplifier is equal to (1+Ra/Rf). In this case, the setting method of the amplification factor is implemented by setting the on/off operation of the switches 512 and 542 on the basis of the setting data 88.

In the case of FIG. 8, every four switches are used for each of the switches 512 and 542 which determine the resistance value, and 1 bit of the setting data 88 is allocated to each of the switches 512 and 542 to switch on one switch 512 of the variable resistor Ra 51 and switch off one switch 542 of the variable resistor Rf 54. The resistance value is varied by the switch which is switched on, and thus the amplification factor is varied.

In this case, the setting data 88 is individually provided for every output, and thus the adjustment can be performed for every output. However, if the amplification is uniformly carried out for all the outputs, the setting data 88 may be common. The setting of the amplification factor of the amplifying circuit 50 is enabled as described above.

In the above case, the resistance values of the variable resistor Ra 51 and the variable resistor Rf 54 are varied on the basis of the setting data 88. However, each of the resistor Rb 52 and the resistor Rc 53 which function as the voltage-dividing resistors of the positive input terminal of the operational amplifier 55 may be constructed by plural resistors and plural switches as in the case of the variable resistor Ra 51 and the variable resistor Rf 54, whereby the resistance values thereof are varied on the basis of the setting data 88.

Further, one or more of these resistors may be designed so that the resistance values thereof can be set. The output voltage Vout can be determined according to the above equation (1) irrespective of combination.

As described above, the liquid crystal applying voltage Vout 95 can be controlled by the offset voltage Vof 90 and the setting data 88 to vary the gray-scale display characteristic.

In the above case, the set register 70 is set by using the set register setting clock 87 and the set register setting data 86. Alternatively, it may be set by using the input display data 84 and the latch signal 91. This method will be described as a fourth embodiment.

According to the liquid crystal driving circuit 1 of this embodiment, with the above function, the gray-scale display characteristic can be changed in accordance with a user's taste, the type of display image (natural picture, computer graphics, text, etc.), characteristics inherent to the device, etc.

Second Embodiment

A second embodiment of the liquid crystal driving circuit according to the present invention will now be described with reference to FIG. 11.

Figure 11:
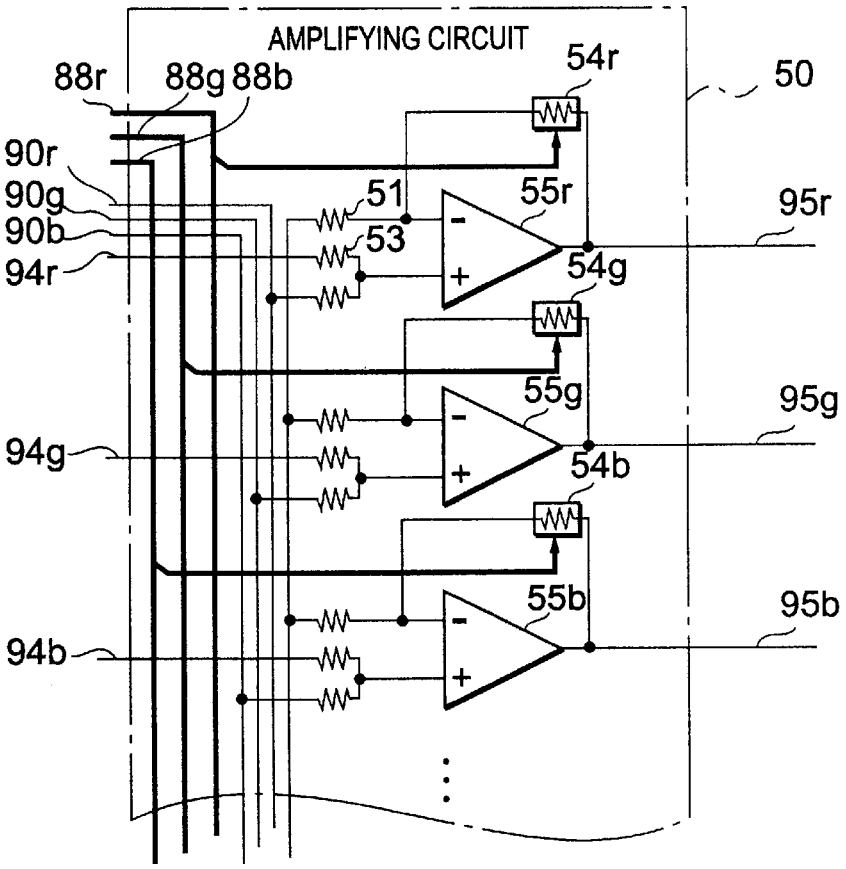
FIG. 11 is a diagram showing the construction of an amplifying circuit of a second embodiment of the liquid crystal driving circuit according to the present invention.

FIG. 11 is an internal block diagram showing the amplifying circuit 50 of the liquid crystal driving circuit 1 according to the second embodiment of the present invention. This embodiment is characterized in that the amplification factor of the amplifying circuit 50 can be set on a color (R, G, B) basis. FIG. 11 is also a block diagram showing the construction of one output of the amplifying circuit 50 as in the case of the embodiment shown in FIG. 8.

In FIG. 11, reference numerals affixed with "r" represent elements associated with R (red), reference numerals affixed with "g" represent elements associated with G (green) and reference numerals affixed with "b" represent elements associated with B(blue). Particularly, reference numeral **90*r* represents an offset voltage Vofr for R(red), reference numeral 90*g* represents an offset voltage Vofg for G(green), and reference numeral 90*b*** represents an offset voltage Vofb for B(blue).

Next, the operation of the amplifying circuit of the liquid crystal driving circuit of this embodiment will be described with reference to FIG. 11.

The liquid crystal driving circuit of this embodiment is effective when it is applied to a liquid crystal panel using RGB color filters. That is, the gray-scale display characteristic can be finely adjusted for every color (R, G, B).

First, the offset adjustment will be described.

The offset voltage 90 has Vofr **90*r*, Vofg 90*g*, Vofb 90*b* which correspond to offset voltages for respective colors (R, G, B). Vofr 90*r* is an offset voltage for R, and used for an offset adjustment for R. Vofg 90*g* is an offset voltage for G, and used for an offset adjustment for G. Vofb 90*b*** is an offset voltage for B, and used for an offset adjustment for B.

These offset voltages **90*f*, 90*g*, 90*b*** are respectively adjusted, and Vof in the equation (1) is replaced by each of Vofr, Vof, Vofb to determine Vout for each color. Accordingly, the offset amount can be adjusted for every color.

In this case, the offset voltage **90*r*, 90*g*, 90*b* of each color shown in FIG. 11** is directly supplied from an external pin.

Next, the amplification factor adjustment will be described.

The amplification factor adjustment of each color is performed as follows. As in the case of the first embodiment, one or more of the variable resistor Ra 51, the resistor Rb 52, the resistor Rc 53 and the variable resistor Rf 54 which determine the amplification factor of each color are respectively constructed by plural resistors and plural switches as shown in FIG. 8, and the on/off operation of the switches are performed on the basis of the setting data **88*r*, 88*g*, 88*b* to change the resistance value for each color. The setting data 88** is individually provided for every color, and the resistance value for each color, that is, the amplification factor for each color, is set.

As described above, the liquid crystal driving circuit 1 of this embodiment can adjust the offset amount and the amplification factor for every color of RGB.

In the above-described first and second embodiments, the offset voltage Vof is directly supplied from the external pins. However, the method of supplying the offset voltage Vof according to the present invention is not limited to the above mode, and the offset voltage Vof may be supplied by a method shown in the following third embodiment.

Third Embodiment

A third embodiment of the liquid crystal driving circuit 1 according to the present invention will be described with reference to FIG. 12. This embodiment is characterized by an offset voltage supply method and an offset voltage supply circuit, and it is substituted for the offset voltage of 90 which is directly supplied from the external pins according to the first and second embodiments.

Figure 12:
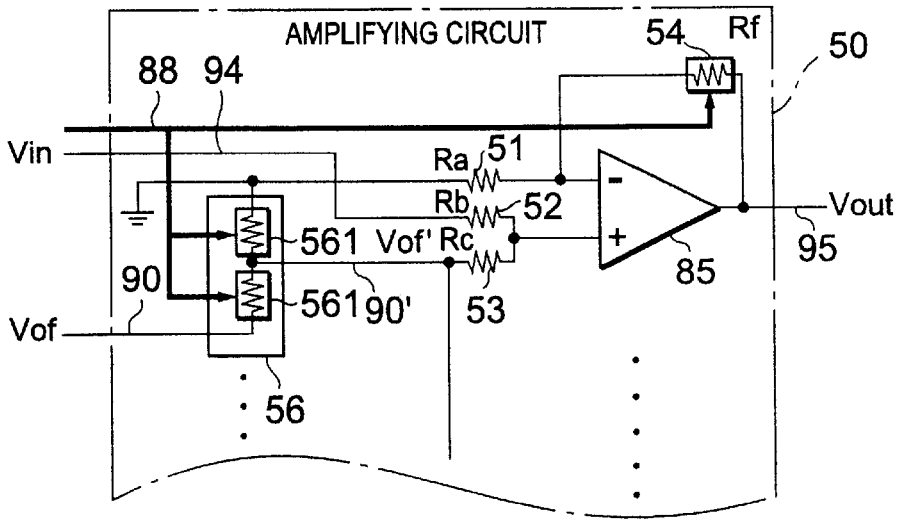
FIG. 12 is a diagram showing the construction of an amplifying circuit according to a third embodiment of the liquid crystal driving circuit of the present invention.

FIG. 12 is a block diagram showing the construction for one output of the offset voltage supply method and the offset voltage supply circuit according to this embodiment.

The amplifying circuit 50 is different from the circuit shown in FIG. 8 in that an offset voltage supply circuit 86 comprising plural variable resistors 561 which are connected to one another in series is added. The offset voltage supply circuit 50 generates a supply circuit generating offset voltage Vof' 90' on the basis of the externally input offset voltage Vof 90 and the setting data 88.

First, the offset voltage Vof 90 from the external is input to the offset voltage supply circuit 86. In the offset voltage supply circuit 86, the voltage between the offset voltage Vof 90 and the ground are resistance-divided by plural variable resistors 561. The voltage obtained by the resistance-division is output as the supply circuit generating offset voltage Vof' 90' and supplied to each operational amplifier 55.

At this time, the setting data 88 are used to control the voltage value (Vof') to be supplied, and the on/off operation of the switches is controlled in accordance with the setting data 88 to set the resistance value of the variable resistor 561.

As described above, according to this embodiment, the voltage value of the offset voltage Vof 90 input is set to a fixed value, and the voltage value is generated on the basis of the setting data 88, whereby the offset voltage can be easily varied and supplied.

Further, when the supply circuit generating offset voltage Vof' 90' is supplied to each color of R, G, B, the setting data 88 and the offset voltage supply circuit 86 may be individually provided for every color. Accordingly, the set register value can be set for every color, and the offset voltage can be supplied for every color.

Fourth Embodiment

A fourth embodiment according to the present invention will now be described with reference to FIG. 13. This embodiment is characterized by a set register 70 setting method and a set register setting circuit, and it is substituted for the set register setting method of the first and second embodiments.

Figure 13:
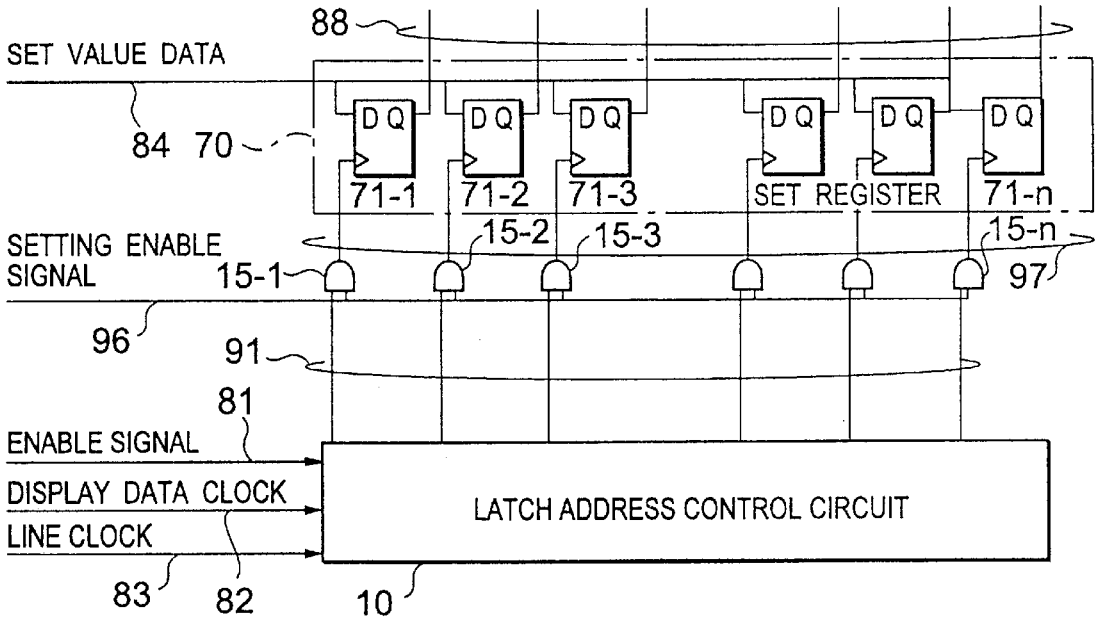
FIG. 13 is a diagram showing the construction of a set register of a fourth embodiment of the liquid crystal driving circuit according to the present invention.

FIG. 13 is a block diagram showing the construction of the set register of the liquid crystal driving circuit according to this embodiment.

This embodiment is different from the set register 70 shown in FIG. 7 in that the set value data 84 are used in place of the set register setting data 86 input to the latch 71 and the output 91 of the latch address control circuit 10 are used in place of the set register setting clock 87.

As in the case of the set register 70 shown in FIG. 7, the set register 70 comprises plural latches 70-1 to **70-*n***.

The data terminal D of the set register 70 is supplied with the input display data 84. The reset terminal of the set register 70 is supplied with a latch signal 91 from the latch address control circuit 10, and also with a latch signal 97 through a latch AND gate 15.

The latch AND gate 15 is supplied with the latch signal 91 from the latch address control circuit 10 and a set enable signal 96 to output the set clock 97.

The latch address control circuit 10 is supplied with an enable signal 81, a display data clock 82 and a line clock 83 as in the case of the first embodiment.

Next, the setting data pickup operation of this embodiment will be described.

As shown in FIG. 1, the latch address control circuit 10 outputs the latch signal 91 to the latch circuit (1) 20 for picking up the display data when the enable signal 81 input is active.

Here, as shown in FIG. 13, in place of the display data, the set value data 84 are input to the set register 70, and the latch signal 91 is output through the latch AND 15 to the set register 70. The latch signal 91 is successively shifted in accordance with the display data clock 83, and the setting clock 97 is active when the setting enable signal 96 input to the latch AND 15 is active (in this case, the signal has a high level).

Accordingly, the set value data on the display data 84 are taken into each bit of the set register 70 in accordance with the latch signal 91.

When all the set value data in the liquid crystal driving circuit of this embodiment are picked up, the latch address control circuit 10 outputs the enable signal 81, and it returns to its initial state when the line clock 83 is input thereto.

According to this embodiment, the pins for inputting the set register setting data 86 of the set register 70 can be reduced in number.

Figure 14:
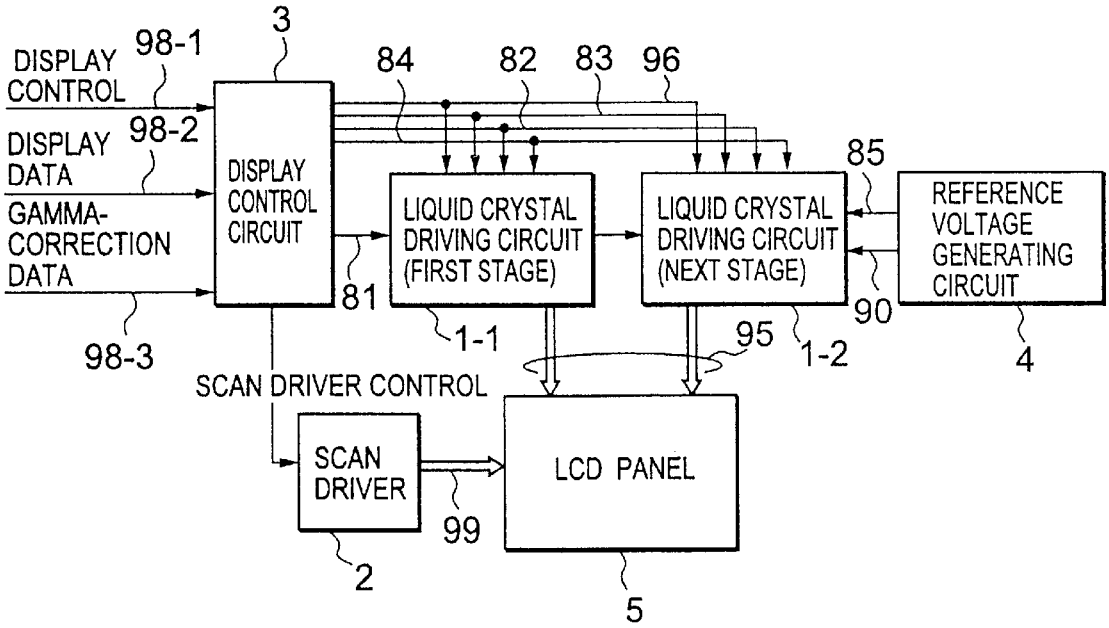
FIG. 14 is a block diagram showing the construction of a liquid crystal display device using the liquid crystal driving circuit according to the fourth embodiment of the present invention.

Next, the construction of a liquid crystal display device using a plurality of liquid crystal driving circuits according to the present invention will be described with reference to FIG. 14.

The liquid crystal display device includes a liquid crystal driving circuit 1—1 at a first stage, a liquid crystal driving circuit 1-2 at a next stage, a scan driver 2, a display control circuit 3, a reference voltage generating circuit 4 and a liquid crystal panel 5.

The display control circuit 3 is supplied with a display control signal 98-1, display data 98-2, and γ-correction data 98-3, and outputs a scan driver control signal 98-4 to the scan driver 2. The scan driver 2 outputs a scan signal 99 to the liquid crystal display device (LCD) panel 5.

The display control circuit 3 outputs to the liquid crystal driving circuit 1 the enable signal 81, the display data clock 82, the line clock 83, the input display data 84 and the setting enable signal 96.

First, the display control circuit 3 generates and outputs the set register setting data from the γ-correction data 98-3 in place of the display data 84 (reference numeral 84 represents the set register setting data in the following description), makes the setting enable signal 96 active, and outputs the enable signal 81 to the liquid crystal driving circuit 1—1 at the first stage.

Upon input of the enable signal 81, the liquid crystal driving circuit 1—1 at the first stage starts to pick up the set register setting data 84 in accordance with the display data clock 83.

In a case of the liquid crystal display device for displaying with a plurality of liquid crystal driving circuits 1 of the present invention, the enable signal 81 output from the liquid crystal driving circuit 1—1 at the initial stage is connected to the enable signal 81 of the liquid crystal driving circuit at the next stage, and the liquid crystal driving circuit 1-2 at the next stage starts to pick up the set value data.

As described above, when a plurality of liquid crystal driving circuits are provided, the next liquid crystal driving circuit starts the pickup operation in response to the enable signal 81. Therefore, if the enable input signal 81 of the liquid crystal driving circuit at the first stage is active to start the pickup operation, the set register setting data 84 and the display data clock 83 can be supplied to each liquid crystal driving circuit for the setting.

When the setting is completed, the liquid crystal driving circuits 1—1 and 1-2 generate the gray-scale voltage on the basis of the reference voltage 85 generated by the reference voltage generating circuit 4, and the control circuit 3 generates various control signals 81 to 83 and the input display data 84 (in the following description 84 represents the input display data) for display on the basis of the display control signal 98-1 and the display data 98-2, and outputs these signals to the liquid crystal driving circuits 1—1 and 1-2. The liquid crystal driving circuit 1—1 and the liquid crystal driving circuit 1-2 pick up the input display data 84 to generate the liquid crystal applying voltage 95.

Further, the control circuit 3 generates the scan driver control signal 98-4, and the scan driver 2 outputs the scan signal 99 in accordance with the scan driver control signal 98-4 to start the scanning operation. As described above, the display is performed on the liquid crystal panel 5 while the gray-scale display characteristic is variable.

The present invention is not limited to the above-described embodiments, and various modifications may be made without departing from the subject matter of the present invention. For example, the offset voltage supply method and the offset voltage supply circuit of the third embodiment may be used in place of the offset voltage supply method and the offset voltage supply circuit of the first and second embodiments.

Further, in the above-described embodiments, the methods and the circuits for adjusting the voltage-dividing resistance ratio of the gray-scale voltage generating circuit, the methods and circuits for adjusting the offset voltage of the amplifying circuit and further adjusting the amplification factor are used in order to adjust the liquid crystal applying voltage value. However, at least one of these methods and circuits may be selected and mounted in the apparatus for the adjustment from the viewpoint of reducing the circuit scale.

The effect obtained by the present invention disclosed in this application is summarized as follows. That is, by applying the present invention to a liquid crystal device, the gray-scale display characteristic can be changed in accordance with a user's taste, the type of display image (natural picture, computer graphics, text or the like), characteristics inherent to a device, etc.

What is claimed is:

1. A display device for displaying display data, comprising:

a display panel;

a driving circuit which generates a gray-scale voltage corresponding to the display data and outputs the gray-scale voltage to the display panel, the driving circuit being capable of changing a brightness curve representing a relationship between a gray-scale of the display data and a display brightness of the display panel between a convex brightness curve and a concave brightness curve, the convex brightness curve being convex with respect to a line representing a linear relationship between the gray-scale of the display data and the display brightness of the display panel, the concave brightness curve being concave with respect to the line representing the linear relationship between the gray-scale of the display data and the display brightness of the display panel;

a scan driver which scans a line on the display panel to which the gray-scale voltage is output; and a control circuit which outputs the display data to the driving circuit and outputs a display control signal to the scan driver.

2. A display device according to claim 1, wherein the driving circuit includes a set register which is capable of changing the brightness curve between the convex brightness curve and the concave brightness curve.

3. A display device according to claim 1, wherein the driving circuit includes:

a gray-scale voltage generating circuit which generates a plurality of gray-scale voltages based on a reference voltage; and a decode circuit which selects the gray-scale voltage corresponding to the display data from the plurality of gray-scale voltages.

4. A display device according to claim 3, wherein the gray-scale voltage generating circuit includes a resistance circuit which generates the plurality of gray-scale voltages by dividing the reference voltage.

5. A display device according to claim 4, wherein the driving circuit further includes a set register which sets at least one resistance value of the resistance circuit.

6. A display device according to claim 4, wherein the driving circuit further includes a set register which is capable of changing at least one voltage dividing ratio of the resistance circuit.

7. A display device for displaying display data, comprising:

a display panel;

a driving circuit which generates a gray-scale voltage corresponding to the display data and outputs the gray-scale voltage to the display panel;

a scan driver which scans a line on the display panel to which the gray-scale voltage is output; and a control circuit which outputs the display data to the driving circuit and outputs a display control signal to the scan driver;

wherein a brightness curve representing a relationship between a gray-scale of the display data and a display brightness of the display panel is changeable between a convex brightness curve and a concave brightness curve, the convex brightness curve being convex with respect to a line representing a linear relationship between the gray-scale of the display data and the display brightness of the display panel, the concave brightness curve being concave with respect to the line representing the linear relationship between the gray-scale of the display data and the display brightness of the display panel.

8. A display device for displaying display data, comprising:

a display panel;

a driving circuit which generates a gray-scale voltage corresponding to the display data and outputs the gray-scale voltage to the display panel, the driving circuit being capable of changing a gray-scale display characteristic of the display data between a first state and a second state, the first state being a state in which a difference in a brightness of the display panel between two adjacent values of the display data in a first gray-scale region is relatively larger than a difference in the brightness of the display panel between two adjacent values of the display data in a second gray-scale region in which a gray-scale is higher than a gray-scale in the first gray-scale region, the second state being a state in which the difference in the brightness of the display panel between two adjacent values of the display data in the first gray-scale region is relatively smaller than the difference in the brightness of the display panel between two adjacent values of the display data in the second gray-scale region;

a scan driver which scans a line on the display panel to which the gray-scale voltage is output; and a control circuit which outputs the display data to the driving circuit and outputs a display control signal to the scan driver.

9. A display device according to claim 8, wherein the driving circuit includes a set register which is capable of changing the gray-scale display characteristic of the display data between the first state and the second state.

10. A display device according to claim 8, wherein the driving circuit includes:

a gray-scale voltage generating circuit which generates a plurality of gray-scale voltages based on a reference voltage; and a decode circuit which selects the gray-scale voltage corresponding to the display data from the plurality of gray-scale voltages.

11. A display device according to claim 10, wherein the gray-scale voltage generating circuit includes a resistance circuit which generates the plurality of gray-scale voltages by dividing the reference voltage.

12. A display device according to claim 11, wherein the driving circuit further includes a set register which sets at least one resistance value of the resistance circuit.

13. A display device according to claim 11, wherein the driving circuit further includes a set register which is capable of changing at least one voltage dividing ratio of the resistance circuit.

14. A display device for displaying display data, comprising:

a display panel;

a driving circuit which generates a gray-scale voltage corresponding to the display data and outputs the gray-scale voltage to the display panel;

a scan driver which scans a line on the display panel to which the gray-scale voltage is output; and a control circuit which outputs the display data to the driving circuit and outputs a display control signal to the scan driver;

wherein a gray-scale display characteristic of the display data is changeable between a first state and a second state, the first state being a state in which a difference in a brightness of the display panel between two adjacent values of the display data in a first gray-scale region is relatively larger than a difference in the brightness of the display panel between two adjacent values of the display data in a second gray-scale region in which a gray-scale is higher than a gray-scale in the first gray-scale region, the second state being a state in which the difference in the brightness of the display panel between two adjacent values of the display data in the first gray-scale region is relatively smaller than the difference in the brightness of the display panel between two adjacent values of the display data in the second gray-scale region.

15. A display device for displaying display data, comprising:

a display panel;

a driving circuit which generates a gray-scale voltage corresponding to the display data and outputs the gray-scale voltage to the display panel, the driving circuit being capable of changing a gray-scale display characteristic of the display data between a first state and a second state, the first state being a state in which a difference in a brightness of the display panel between two adjacent values of the display data in a first gray-scale region is relatively smaller than a difference in the brightness of the display panel between two adjacent values of the display data in a second gray-scale region in which a gray-scale is higher than a gray-scale in the first gray-scale region, the second state being a state in which the difference in the brightness of the display panel between two adjacent values of the display data in the first gray-scale region is relatively larger than the difference in the brightness of the display panel between two adjacent values of the display data in the second gray-scale region;

a scan driver which scans a line on the display panel to which the gray-scale voltage is output; and a control circuit which outputs the display data to the driving circuit and outputs a display control signal to the scan driver.

16. A display device for displaying display data, comprising:

a display panel;

a driving circuit which generates a gray-scale voltage corresponding to the display data and outputs the gray-scale voltage to the display panel;

a scan driver which scans a line on the display panel to which the gray-scale voltage is output; and a control circuit which outputs the display data to the driving circuit and outputs a display control signal to the scan driver;

wherein a gray-scale display characteristic of the display data is changeable between a first state and a second state, the first state being a state in which a difference in a brightness of the display panel between two adjacent values of the display data in a first gray-scale region is relatively smaller than a difference in the brightness of the display panel between two adjacent values of the display data in a second gray-scale region in which a gray-scale is higher than a gray-scale in the first gray-scale region, the second state being a state in which the difference in the brightness of the display panel between two adjacent values of the display data in the first gray-scale region is relatively larger than the difference in the brightness of the display panel between two adjacent values of the display data in the second gray-scale region.

17. A display device for displaying display data, comprising:

a display panel;

a driving circuit which generates a gray-scale voltage corresponding to the display data and outputs the gray-scale voltage to the display panel, the driving circuit being capable of changing a gray-scale display characteristic of the display data between a first state and a second state, the first state being a state in which a difference in a brightness of the display panel between two adjacent values of the display data becomes smaller as a gray-scale of the display data increases, the second state being a state in which the difference in the brightness of the display panel between two adjacent values of the display data becomes larger as the gray-scale of the display data increases;

a scan driver which scans a line on the display panel to which the gray-scale voltage is output; and a control circuit which outputs the display data to the driving circuit and outputs a display control signal to the scan driver.

18. A display device according to claim 17, wherein the driving circuit includes a set register which is capable of changing the gray-scale display characteristic of the display data between the first state and the second state.

19. A display device according to claim 17, wherein the driving circuit includes:

a gray-scale voltage generating circuit which generates a plurality of gray-scale voltages based on a reference voltage; and a decode circuit which selects the gray-scale voltage corresponding to the display data from the plurality of gray-scale voltages.

20. A display device according to claim 19, wherein the gray-scale voltage generating circuit includes a resistance circuit which generates the plurality of gray-scale voltages by dividing the reference voltage.

21. A display device according to claim 20, wherein the driving circuit further includes a set register which sets at least one resistance value of the resistance circuit.

22. A display device according to claim 20, wherein the driving circuit further includes a set register which is capable of changing at least one voltage dividing ratio of the resistance circuit.

23. A display device for displaying display data, comprising:

a display panel;

a driving circuit which generates a gray-scale voltage corresponding to the display data and outputs the gray-scale voltage to the display panel;

a scan driver which scans a line on the display panel to which the gray-scale voltage is output; and a control circuit which outputs the display data to the driving circuit and outputs a display control signal to the scan driver;

wherein a gray-scale display characteristic of the display data is changeable between a first state and a second state, the first state being a state in which a difference in a brightness of the display panel between two adjacent values of the display data becomes smaller as a gray-scale of the display data increases, the second state being a state in which the difference in the brightness of the display panel between two adjacent values of the display data becomes larger as the gray-scale of the display data increases.

* * * * *